United States Patent [19]

Roch et al.

[11] Patent Number: 4,847,775

[45] Date of Patent: Jul. 11, 1989

[54] METHOD AND DEVICE FOR CONTROLLING THE SETTING OF THE COMPONENTS OF A PRINTING AND CUTTING MACHINE

[75] Inventors: Roger Roch, Cossonay; Claude Chablais, Penthalaz; Vaclav Vitous, Bussigny, all of Switzerland

[73] Assignee: Bobst SA, Switzerland

[21] Appl. No.: 24,706

[22] Filed: Mar. 11, 1987

[30] Foreign Application Priority Data

Mar. 17, 1986 [CH] Switzerland ..... 1071/86

[51] Int. Cl.[4] ..... B65H 23/00

[52] U.S. Cl. ..... 364/469; 364/131; 364/138; 364/190

[58] Field of Search ..... 364/468–471, 364/131, 132, 138, 139, 188, 190; 235/375, 437, 475

[56] References Cited

U.S. PATENT DOCUMENTS

| | | | |
|---|---|---|---|
| 3,806,012 | 4/1974 | Roch | 226/28 |
| 4,366,753 | 1/1983 | Glanz et al. | 364/470 X |
| 4,495,582 | 1/1985 | Dessert et al. | 364/518 X |
| 4,525,788 | 6/1985 | Gottlieb et al. | 364/471 X |
| 4,527,468 | 7/1985 | Piotroski | 364/471 X |
| 4,527,790 | 7/1985 | Piotroski | 364/471 X |
| 4,527,791 | 7/1985 | Piotroski | 364/471 X |
| 4,547,856 | 10/1985 | Piotroski et al. | 364/471 X |
| 4,570,217 | 2/1986 | Allen et al. | 364/188 |

FOREIGN PATENT DOCUMENTS

| | | |
|---|---|---|
| 0043201 | 1/1982 | European Pat. Off. . |
| 0177885 | 4/1986 | European Pat. Off. . |
| 2145543 | 3/1985 | United Kingdom . |
| 2181865 | 4/1987 | United Kingdom . |

OTHER PUBLICATIONS

Brochure of MicroTouch Systems Inc., entitled "Introducing The MicroTouch Screen" (1985).

*Primary Examiner*—Allen MacDonald

*Attorney, Agent, or Firm*—Hill, Van Santen, Steadman & Simpson

[57] ABSTRACT

A method and apparatus for controlling the setting of the components of a printing machine use a calculating unit which receives all of the data regarding the operating status of each of the components to be controlled. The calculating unit process data relating to the running of the web and compares the data with data obtained by read heads, also sensing the web. The data from the read heads is supplied to the memory of a computer, the computer also having a touch screen for permitting direct control and setting of the components. A printer and a photographic recorder are coupled with the touch screen for displaying the images thereon.

4 Claims, 6 Drawing Sheets

METHOD AND DEVICE FOR CONTROLLING THE SETTING OF THE COMPONENTS OF A PRINTING AND CUTTING MACHINE

BACKGROUND OF THE INVENTION

1. Field of the Invention

The present invention is directed to a method and apparatus for controlling the setting of various components of a printing and cutting machine.

2. Description of the Prior Art

The various components of printing, cutting, folding and gluing machines are set in a particular manner with respect to the jobs to be done. Each setting operation requires a device for setting the positioning for each component. One such positioning and setting device is described in Swiss Pat. No. 539 508 corresponding to U.S. Pat. No. 3,806,012. In a printing machine, for instance, this device controls the length registering of the successive prints on a paper or cardboard web. It also allows progressive checking of the tension or lengthening of the web, as well as the previous keying of the printer. By combining processing and memory units with this device, a diagnosis of the registering can be made available on several display units, each corresponding to a precise function such as, for example, the waste ejection or analysis of the production statistics.

SUMMARY OF THE INVENTION

It is an object of the present invention to provide a method and apparatus for controlling setting of the various components of a printing and cutting machine by simple manual contact with a touch screen of a computer.

The above objects are achieved in accordance with the principles of the present invention in a device having a calculating unit which receives information from and transmits information to each of the components in the various stations of the controlled machine. The calculating unit is connected to a memory, which also receives data via the calculating unit from various read heads indicating the actual current position and other current status characteristics of the web. The information regarding the current status of each of the controlled components and the actual status of the web are supplied to a memory, which is connected to a computer, which is also connected to the calculating unit. Any changes which may be necessary during operation of the machine can be simply made by an operator via a touch screen connected to the computer.

DESCRIPTION OF THE PREFERRED EMBODIMENTS

Figure 1:
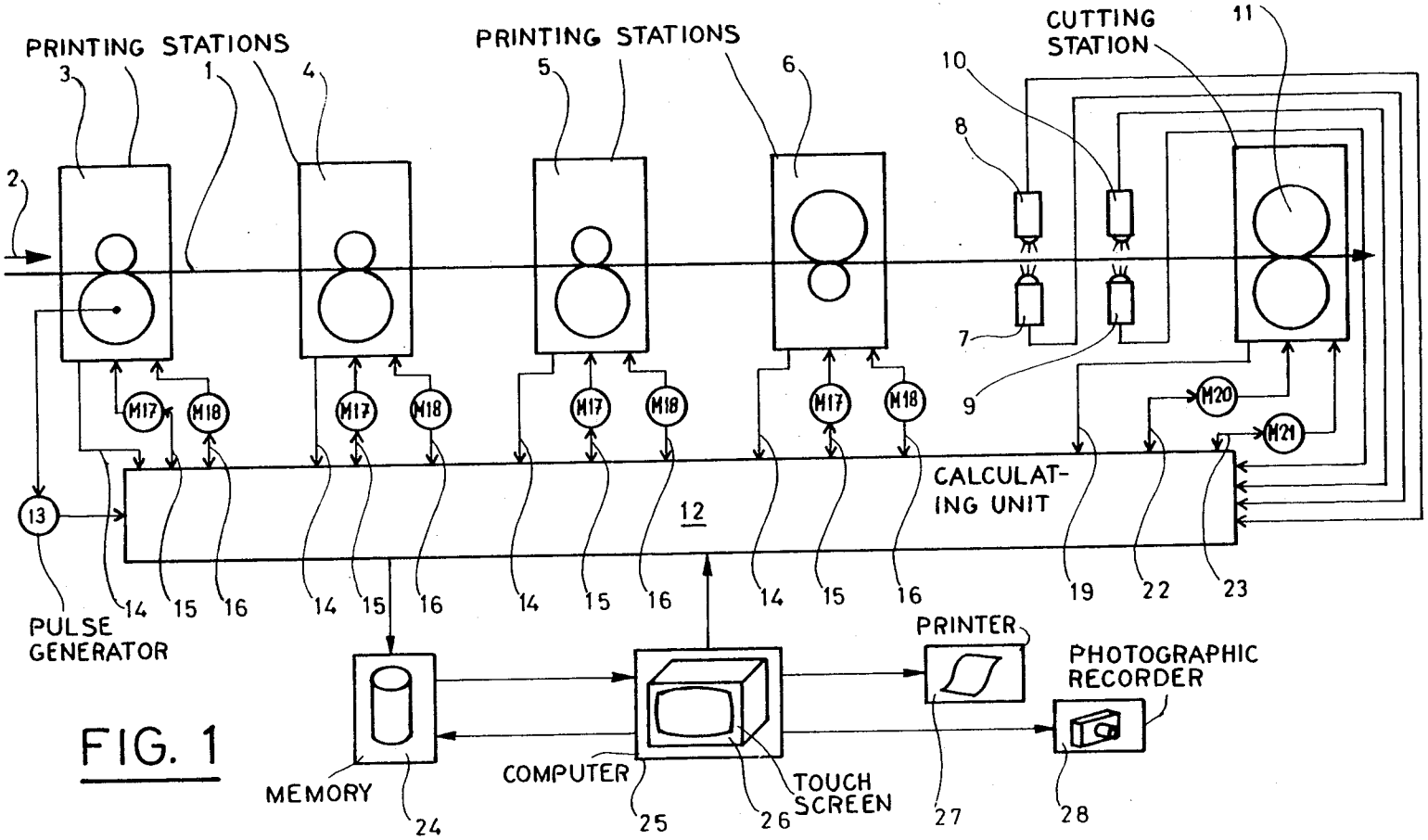
FIG. 1 is a schematic block diagram of an apparatus for controlling the setting of various components in a printing and cutting station constructed in accordance with the principles of the present invention.

FIG. 1 schematically shows a registering device for a printing machine in which a paper or cardboard web 1 runs in the direction of arrow 2 through a series of printing stations 3, 4, 5 and 6. The printing stations 3 through 6 can print recto or verso. In the exemplary embodiment of FIG. 1, the stations 3 through 5 operate in the recto mode, whereas the station 6 operates in the verso mode. Following the printing station 6, the web 1 runs through a first set of shiftable (moveable) read heads 7 and 8. The read head 7 detects the registration marks on the recto print and the read head 8 detects the verso registration marks. The read head 7 and 8 shift laterally with regard to the direction of the running of the web 1. In terms known to those skilled in the art, the web 1 runs in the machine direction, and the read heads 7 and 8 shift in the cross-machine direction.

A second set of read heads 9 and 10 is disposed before a cutting station 11, shown in the embodiment of FIG. 1 as a rotating cutting station. The cutting station may alternatively be combined with a platen press preceded with a fed unit (not shown) in which the web material is accumulated during the cutting operation.

Figure 2:
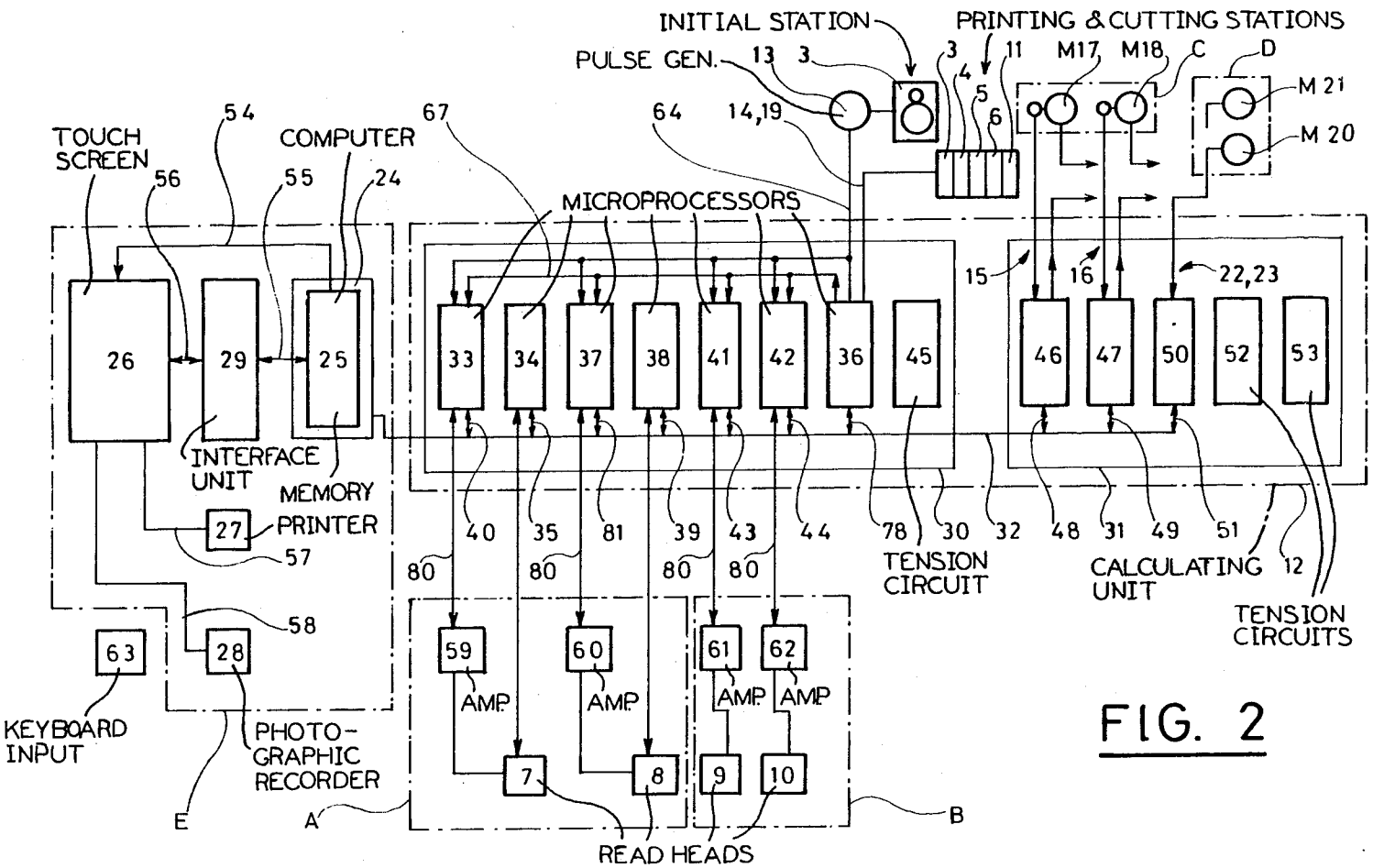
FIG. 2 is a schematic electrical block diagram of the device shown in FIG. 1.

For setting the length of lateral registration of the print on the web 1, the read heads 7 and 8 provide data to a calculating unit 12, described in greater detail in FIG. 2. The calculating unit 12 also receives data from a pulse generator 13 mechanically connected with the printing cylinder control for the printing station 3. The data provided by the pulse generator 13 thus represent the running conditions of the web 1. The printing station 3, being the initial printing station, also provides information to the calculating unit 12 via line 14 relating to the starting conditions of the web 1, such as when the printing cylinder is in contact with the web 1, when the ink pots are filled and positioned, when the registration marks have been selected, and the like. Such data are called "machine information." The calculating unit 12 also receives data regarding the length and lateral registration of the web 1 through lines 15 and 16. Lines 15 and 16 provide values based on the angular position of motors M17 and M18. The motor M17 provides information regarding length registration, and motor M18 provides information regarding lateral registration. The printing stations 4 through 6 are also connected to the calculating unit 12 just as the station 3, however the stations 4 through 6 do not provide data regarding these initial conditions.

The read heads 9 and 10 associated with the cutting station 11 also supply data to the calculating unit 12. The cutting station 11 also provides "machine information" to the calculating unit 12 via line 19. In the cutting station 11, motor M20 corrects lateral registration, and provides information to (and receives information from) the calculating unit 12 via line 22. Motor M21 corrects length registration, and is also connected to the calculating unit 12 via a two-way line 23.

As explained in greater detail in connection with FIG. 2, all of the information which is processed by the calculating unit 12 is stored in a memory unit 24, from which the stored values are transmitted to a computer 25 wherein the data are transformed into graphic and alpha-numeric symbols which are sent to and displayed on a touch screen 26 linked with the computer 25. The computer 25 is also connected to a hard copy printer 27 and a photographic recorder 28 for reproducing the image displayed on the touch screen 26. The computer 25 is also connected to the calculating unit 12 so that the components of the machine can be controlled by an operator via the touch screen 26.

A schematic circuit diagram for the device shown in FIG. 1 is shown in FIG. 2. In FIG. 2, block A includes the shiftable read heads 7 and 8 which detect the registration mark on both sides of the web, thus recto-verso reading of the printing registration marks takes place in block A. Block B encompasses the read heads 9 and 10 located before the cutting group 11, wherein recto-verso reading of the cutting registration marks take place. A first actuating block C includes motors M17 and M18 for correcting the printing registration. Each printing station is equipped with a motor M17 and a motor M18, thus four sets of motors M17 and M18 will be provided. A second actuating block D includes the motors M20 and M21 for the cutting registration correction. A displaying and controlling block E includes the memory unit 24, the computer 25 and the touch screen 26, provided with an interface 29, the hard copy printer 27 and the photographic recorder 28. The computer 25 and the interface 29 convert the data collected by a control bus 32 into graphic and alpha-numeric symbols.

The calculating unit 12 is divided in FIG. 2 into levels 30 and 31 connected by the control bus 32. The first level 30 contains the registration monitoring components, whereas the second level 31 contains components for correcting printing and cutting registration errors. The first level 30 includes a first read microprocessor 33 connected with a motor control microprocessor 34 through the control bus 32 by a line 35, for processing data received from the read head 7. The pulse generator 13 is connected to a microprocessor 36, which processes the data provided by the pulse generator 13 as well as the aforementioned machine information. The control microprocessor 34 receives the data via the line 35 needed for motor shifting the read head 7 which detects the registration marks of the recto prints. The first level 30 is also provided with a second read microprocessor 37 connected to a second control microprocessor 38 via a line 39 of the control bus 32. The two microprocessors 37 and 38 correspond to the microprocessors 33 and 34, however, process information regarding the verso print provided by the read head 8, and control motor shifting of the read head 8. The microprocessors 33 and 37 are connected to the control bus 32 via lines 40 and 81.

The first level 30 also includes microprocessors 41 and 42, each of which also receives data from the pulse generator 13 and the microprocessor 36. The microprocessor 41 processes data from the read head 9 detecting the recto cutting registration marks, and the microprocessor 42 processes information from the read head 10 detecting the verso cutting registration marks. The microprocessors 41 and 42 are coupled with the control bus 32 via respective lines 43 and 44. The first level 30 also includes a tension circuit 45 for setting the tension of web 1. The tension circuit 45 may be any type of circuit well known to those skilled in the art for setting tension, such as a simple switch.

The second level 31 includes a first motor control microprocessor 46 which processes the data for length correction motors M17 for the print, and a second motor control microprocessor 47 for processing data for the lateral correction motors M18 of the print. The microprocessors 46 and 47 are connected to the control bus 32 via lines 48 and 49. The second level 31 also incudes a microprocessor 50 controlling the motors M20 and M21 for the cutting registration correction. As stated above, the motor M20 corrects the length cutting registration and the motor M21 corrects the lateral cutting registration. The microprocessor 50 is connected to the control bus 32 via a line 51.

Tension is set in the second level 31 by a tension circuit 52. Both the tension circuits 45 and 52 may be a part of a general operating circuit 53.

The control bus 32 supplies all data from the above machine components to the memory 24 of the computer 25. The computer 25 is connected to the touch screen 26 via a line 54, and to the interface 29 of the touch screen 26 via the two-way line 55. The interface 29 and the touch screen 26 are connected by the two-way line 56. Data displayed on the touch screen 26 are sent to the printer 27 and the photographic recorder 28 by respective lines 57 and 58.

The data to and from the read heads 7 and 8 are amplified in respective amplifiers 59 and 60, and the data to and from read heads 9 and 10 are amplified in respect to amplifiers 61 and 62.

All of the aforementioned components are operated by a keyboard input 63.

Figure 3:
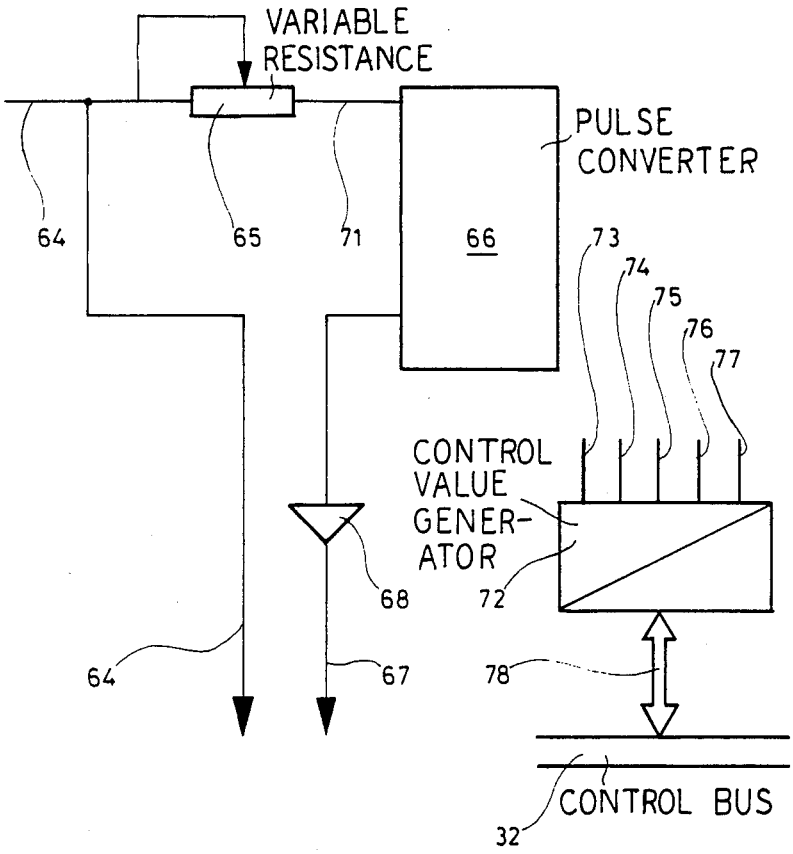
FIG. 3 is a schematic block diagram showing further details of the components for setting each of the controlled components in the machine of FIG. 1.

Further details of the interfacing microprocessor 36 are shown in FIG. 3. Data from the pulse generator 13 are supplied on line 64 to a variable resistance 65 before being entered via line 71 in a pulse converter 66. The pulse converter 66 transforms the pulses from the pulse generator 13 into electrical signal providing information on the running of web 1 in the machine. Each electrical signal is a pulse with a period corresponding to a 1/100 mm portion of the web 1. The signals from the converter 66 are supplied through an amplifier 68 to line 67, which is connected to the other microprocessors 33, 37, 41 and 42 shown in FIG. 2, which also received information on line 64 from the pulse generator 13. The microprocessor 36 also includes a control value generator 72, which may be a sub-microprocessor, for converting the machine information into values for the control bus 32. The machine information is supplied on as many separate input lines as are needed for each different characteristic being monitored, such as lines 73, 74, 75, 76 and 77 which may be contained in lines 14 and 19. The values from the control value generator 72 are supplied to the control bus 32 via line 78. The control value generator 72 receives the information on its input lines and compares the incoming information to reference values. In the case of an operating fault, the control value generator 72 can either stop the machine, or suppress the default via the control bus 32.

Figure 4:
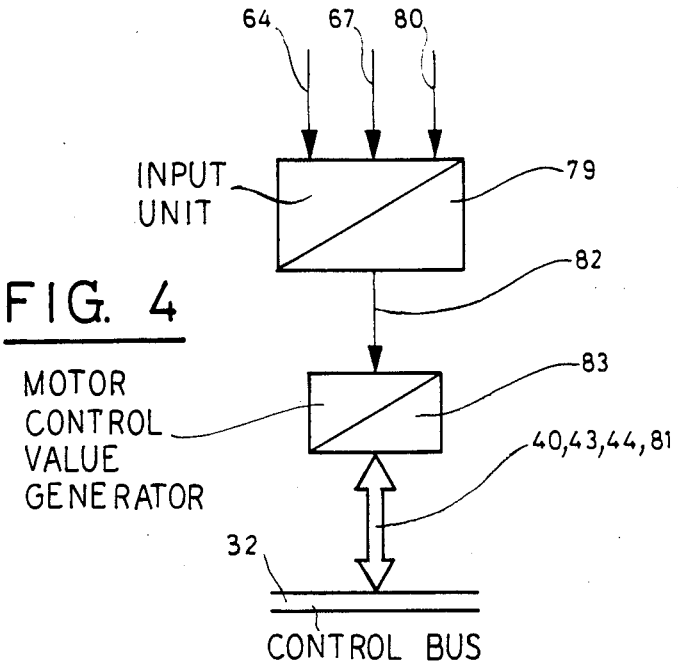
FIG. 4 is a schematic block diagram showing further details of the components for generating motor control values for the device of FIG. 1.

FIG. 4 is a schematic diagram showing further details of either one of the read microprocessors 33, 37, 41 or 42. Each of those microprocessors includes an input unit 79 which receives information from the pulse generator 13 on line 64, information from the output of the interface microprocessor 36 on line 67, and information from one of the amplifiers 59, 60, 61 or 62 on line 80. The input unit 79 processes the incoming information and converts the information into a form suitable for futher processing in a motor control generator 83, connected to the input units 79 via a line 82. The motor control value generator 83 generates control signals for the respective motors based on the incoming data. Those signals are supplied to the control bus 32 via one of lines 40, 43, 44 or 81, depending upon the respective microprocessor which is processing the information.

Figure 5:
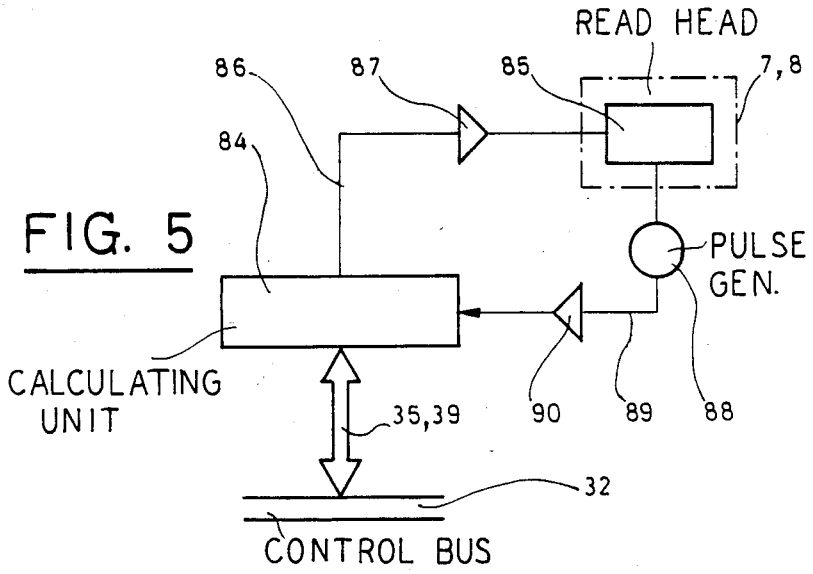
FIG. 5, is a schematic block diagram showing components for obtaining values from the read heads in the device shown in FIG. 1.

The details of each motor control microprocessors 34 and 38 are shown in FIG. 5. In these microprocessors, control information is provided by the control bus 32 via lines 35 and 39 to a calculating unit 84 which may be, for example, a position/ speed control regulator. Based on the incoming information, the calculating unit 84 controls a motor 85 for shifting the read heads 7 and 8. The output of the calculating unit 84 is supplied to the motor 85 on line 86 through an amplifier 87. The motor 85 has a pulse generator 88 in a return control look 89. The output of the pulse generator 88 is supplied back to the calculating unit 84 through an amplifier 90.

Figure 6:
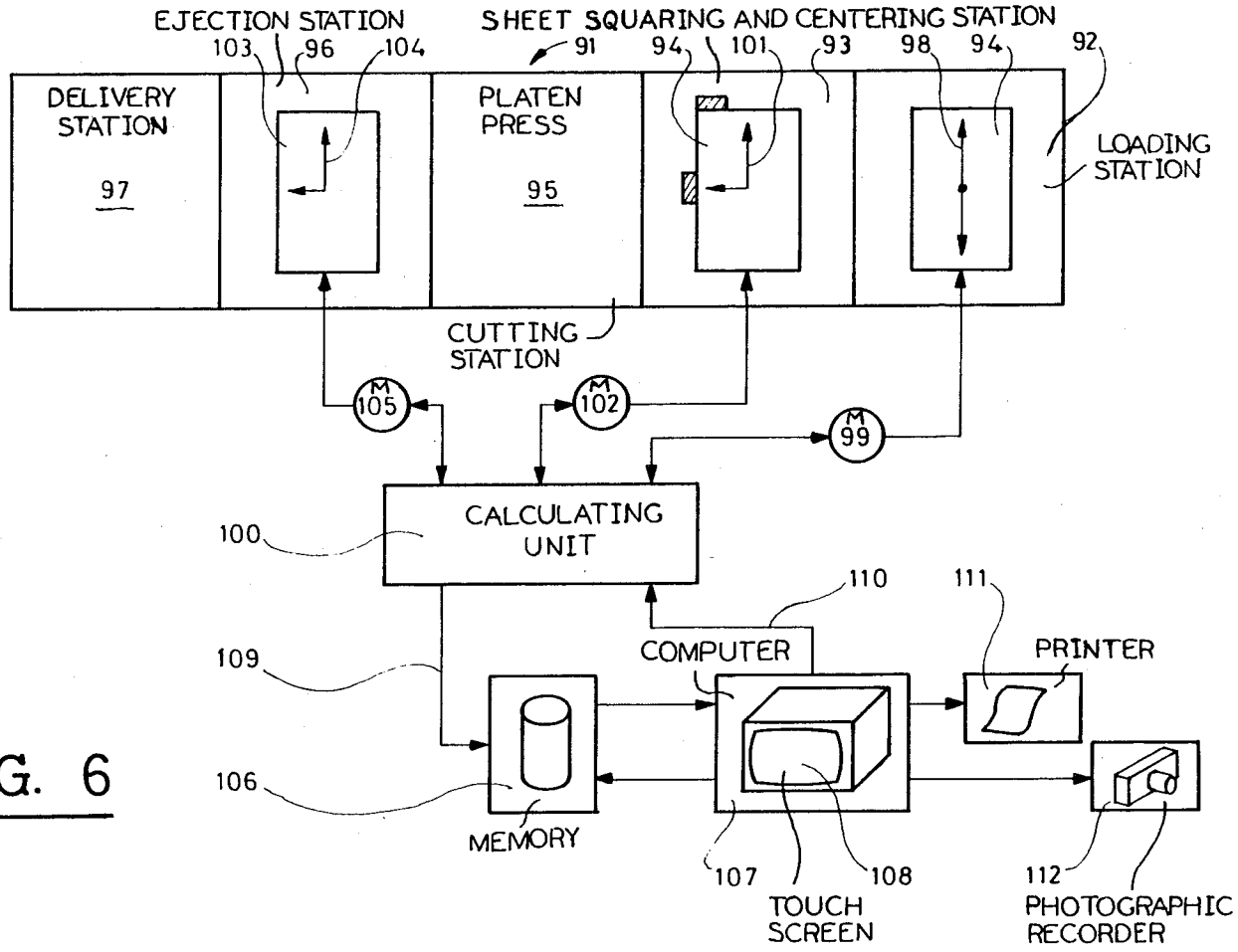
FIG. 6 is a block diagram showing the components for controlling a platen press in accordance with the principles of the present invention.

A schematic diagram of a platen press 91 operated in accordance with the principles of the present invention is shown in FIG. 6. The platen press 91 includes a loading station 92, a sheet squaring and centering station 93, a cutting station 95, an ejection station 96, and a delivery station 97. In the loading station 92, a pile of sheets 94 is disposed on a carriage (not shown) for lateral shifting along the double arrow 98. A motor M99, which may be either a step motor or a dynamotachymetric motor, shifts the carriage as needed. Data identifying the angular position of the motor M99 are sent to a calculating unit 100, comparable to the calculating unit 12 of FIG. 1. Thus a first centering of the sheet 94 is achieved and recorded. The squaring and centering station 93 is also provided with a means (not shown) for shifting the sheet 94 in the direction of the right-angled arrows 101. This shifting is accomplished with a motor M102, similar to the motor M99. The angular position of the motor M102 is also sent to the calculating unit 100. The ejection station 96 is provided with tools 103 mounted in frames (not shown) shiftable in the direction of arrows 104. Shifting of the frames is controlled by a motor M105, similar to the motors M99 and M102. The angular position of the motor M105 is also provided to the calculating unit 100. As indicated, data can also be supplied from the calculating unit 100 to each of the motors M99, M102 and M105.

Photo cells or other devices (not shown) known to those skilled in the art, operating similar to the read heads 7 or 10 in FIG. 1, detect the position of the components which are to be shifted. As in the embodiment shown in FIG. 1, the calculating unit 100 is connected via line 109 with a memory 106 which is connected to a computer 107 for converting the data into graphic and alpha-numeric symbols for display on a touch screen 108. The computer 107 is connected to the calculating line 100 via a line 110 so that all stations of the platen press 91 can be controlled by an operator via the touch screen 108. The computer 107 is connected to a hard copy printer 111 and a photographic recorder 112.

Figure 7:
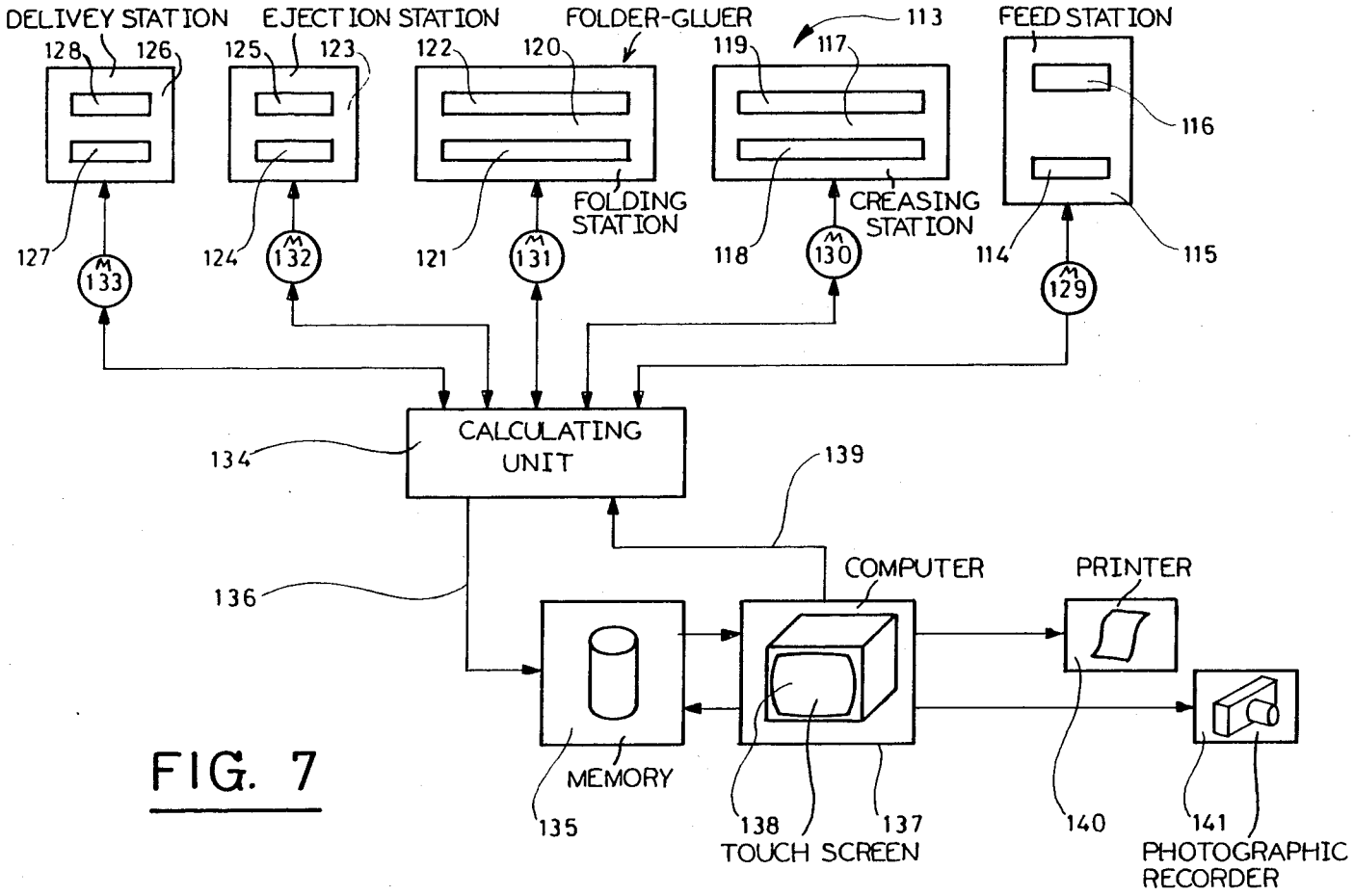
FIG. 7 is a block diagram showing the components for controlling a folder-gluer in accordance with the principles of the present invention.

A schematic diagram of a folder-gluer 113 operated in accordance with the principles of the present invention is shown in FIG. 7. The folder-gluer 113 includes a feed station 114 having two jaws 115 and 116 to be set with respect to the width of the box blank to be processed, a fold and blank creasing (or pre-creasing) staton 117 with two conveyors 118 and 119, a folding station 120 with two folders 121 and 122, an ejection station 123 with two ejectors 124 and 125, and a delivery station 112 having two feeders 127 and 128. Each of the conveyors 118 and 119, the folders 121 and 122, the ejectors 124 and 125 and the feeders 127 and 128 are to be laterally set with respect to the size and type of box blank to be folded. Each of the stations is therefore respectively provided with motors M129, M130, M131, M132, M133, each of which may either be a step motor or a dynamotachymetric motor. Each of the motors are electrically connected by two-ways lines to a calculating unit 134 similar to the calculating unit 12 of FIG. 1. As in the embodiments of FIGS. 1 and 6, the calculating unit 134 is connected to a memory 135 via a line 136. The memory 135 is connected to a computer 137 provided with a touch screen 138. The computer 137 is also connected to the calculating unit 134 via a line 139 for controlling the various components of the folder-gluer 113 via the touch screen 138. The computer 137 is connected to a hard copy printer 140 and a photographic recorder 141.

An exemplary setting of the printer shown in FIG. 1 may be accomplished as follows. Similar operations can be undertaken for each of the platen press 91 or the folder-gluer 113 shown in FIGS. 6 and 7. The control device is set at a selected tension and a main menu is displayed on the touch screen 26. A desired function can be selected by touching its graphic representation on the screen 26. A sub-menu will then be displayed. As soon as the operator removes his or her finger from the screen, the following functions may be selected;

graphic display of the registration marks;

assignment of specific marks to the recto-verso printing stations;

assignment of the color of the selected marks;

assignment of each mark to a printing or cutting station.

With the machine operating parameters now set, the machine can be started simply by touching the screen. Henceforth the computer 25 displays an image permitting constant checking of the selected parameters. If the displayed values exceed desired tolerances, a correction menu can be displayed to permit correction of the excess values without stopping the machine.

The method and apparatus disclosed herein permit automatic control of all of the components used to set parameters in a cardboard processing machine. The method and apparatus considerably reduce the dimensions of the components such as desks and keyboards normally used to control such machines, while stll permitting a constant checking of the operating condition of the machine during operation.

Although modifications and changes may be suggested by those skilled in the art it is the intention of the inventors to embody within the patent warranted hereon all changes and modifications as reasonably and properly come within the scope of their contribution to the art.

We claim as our invention:

1. In a machine having a plurality of components operable on a web having registration marks thereon, said components arranged in respective stations of a machine through which said web moves, said stations including a printing station with a first motor therein for correcting length registration of a print on said web and a second motor therein for correcting lateral registration of a print on said web, a cutting station having a third motor therein for correcting length registration of a cutting operation on said web and a fourth motor therein for correcting lateral registration of said cutting operation on said web, an apparatus for controlling the setting with respect to said web of each of said components comprising:

means for detecting information identifying a current operational and positional status for each of said components;

means for converting said information into respective electronic signals;

means for storing said signals:

means for converting the stored signals into graphic and alpha-numeric data;

a computer having a touch screen on which said graphic and alpha-numeric data for each of said stations is displayable, said computer having means for supplying control signals for the setting of each of said components by manually contacting selected data displayed on said touch screen;

wherein said means for detecting information includes in said print station at least one read head disposed for reading said registration marks on said web;

a fifth motor mechanically connected to said read head and electrically connected to said means for supplying control signals for laterally shifting said read head in response to one of said control signals;

a roll in said print station over which said web passes and a pulse generator means connected to said roll for providing a pulse train corresponding to the angular position of said roll;

an interface processor connected to said means for detecting information, including connection to said pulse generator, to each of said stations, and to said computer;

at least one first motor control microprocessor connected to said fifth motor and connected to said interface processor and to said pulse generator;

at least one read microprocessor connected to said read head for receiving registration information therefrom;

a second motor control microprocessor connected to said first motor in said printing station;

a third motor control microprocessor connected to said second motor in said printing station;

a fourth motor control microprocessor connected to both said third and fourth motors in said cutting station; and a bus which is part of said means for supplying control signals connecting each of said microprocessors to said computer to permit setting of the motors in said stations via said computer by said contacting of said touch screen.

2. An apparatus as claimed in claim 1, wherein said means for storing said signals is a memory connected to said bus.

3. An apparatus as claimed in claim 1, wherein said means for detecting comprises a plurality of photo cells.

4. An apparatus as claimed in claim 1 further comprising a printer and a photographic recorder for recording said data displayed on said touch screen.

* * * * *